US007083454B2

(12) United States Patent
Suzuki

(10) Patent No.: US 7,083,454 B2
(45) Date of Patent: Aug. 1, 2006

(54) CONNECTOR

(75) Inventor: Masayuki Suzuki, Tokyo (JP)

(73) Assignee: DDK Ltd., Tokyo (JP)

( * ) Notice: Subject to any disclaimer, the term of this patent is extended or adjusted under 35 U.S.C. 154(b) by 0 days.

(21) Appl. No.: 11/015,171

(22) Filed: Dec. 17, 2004

(65) Prior Publication Data

US 2005/0136732 A1 Jun. 23, 2005

(30) Foreign Application Priority Data

Dec. 19, 2003 (JP) ..... 2003-422259

(51) Int. Cl.
*H01R 13/15* (2006.01)

(52) U.S. Cl. ..... 439/260; 439/495

(58) Field of Classification Search ..... 439/260, 439/495

See application file for complete search history.

(56) References Cited

U.S. PATENT DOCUMENTS 6,726,497 B1 * 4/2004 Nogawa et al. ..... 439/260

6,855,002 B1 * 2/2005 Chiu ..... 439/495

* cited by examiner

*Primary Examiner*—Gary Paumen
(74) *Attorney, Agent, or Firm*—Abelman, Frayne & Schwab

(57) ABSTRACT

A connector to be detachably fitted with a flexible printed circuit board or a flexible flat cable includes a required number of contacts, a housing for holding and fixing therein the contacts, and a slider for pressing the circuit board or flat cable against the contacts. The housing is provided with anchoring portions at locations corresponding to connection portions of the contacts. Connection portions of the contacts are each formed with an oblique recess to engage the anchoring portion of the housing. When the contact is being inserted into an insertion groove of the housing, a contact portion of the contact comes into contact with an upper wall of the insertion groove, but on proceeding of the insertion, the contact portion of the contact will return into parallel with the insertion groove with the aid of guidance of the engagement of the oblique recess with the anchoring portion of the housing without any oblique positioning of contacts, thereby achieving stable electrical connection of the connector.

6 Claims, 3 Drawing Sheets

CONNECTOR

BACKGROUND OF THE INVENTION

The present invention relates to a connector having a mechanism for pressing contacts against a flexible printed circuit board or flexible flat cable for use in a mobile phone or cellular phone, notebook personal computer, digital camera and the like, and more particularly to a connector capable of inserting contacts in parallel with insertion grooves of its housing.

Among the connectors for use in mobile phones, charge couples device (CCD) cameras and the like, connectors of one kind mainly comprise a housing and contacts, and a flexible printed circuit board is inserted into the housing to be brought into contact with contact portions of the contacts. This type of connectors is so-called "non-zero-insertion force" (NZIF) type. The connectors of the other kind mainly comprise a housing, contacts and a slider so that a flexible printed circuit board is embraced by the housing and the slider. The connectors of this type are so-called "zero-insertion force" (ZIF) type or "piano touch" type. There may be various methods for holding the flexible printed circuit board by the housing and the slider. In many cases, after a flexible printed circuit board has been inserted into the housing, the slider is inserted to press the board against the contacts, or after a flexible printed circuit board has been inserted, the slider is pivotally moved to press the board against the contacts.

The housing is formed with a required number of insertion grooves into which the contacts are inserted and further formed with a fitting opening into which a flexible printed circuit board is inserted.

The contacts each mainly comprise a contact portion adapted to contact a flexible printed circuit board, a connection portion to be connected to a hard board or the like, and a fixed portion to be fixed to the housing. These contacts are fixed to the housing as by press-fitting.

Typically shown are a patent literature 1 (Japanese Utility Model Application Opened No. H6-60,983/1994) for the Z1F type connector and a patent literature 2 (Japanese Patent Application Opened No. H13-257,020/2001) for the piano touch type connector. The applicant of the present application has proposed a connector disclosed in a patent literature 3 (Japanese Patent Application No. 224,340/2002) which is capable of securely pressing a flexible printed circuit board or flexible flat cable against contact portions of contacts and is able to achieve even narrower pitches of contacts and minimization of height or lower geometry.

Patent Literature 1

Japanese Utility Model Application Opened No. H6-60, 983/1994 discloses one example of the "zero-insertion force" type connectors. As can be seen from the "Abstract" of the Japanese Utility Model, this invention relates to a connector with a slider for a print board for use in a narrow space in an electronic or communication appliance. The slider is formed at the ends on both sides with U-shaped arms with their proximal ends fixed to the slider as guiding means when being inserted into a housing. The U-shaped arms are each provided on its opening side with a projection and formed with a notch such that the opening end is visible from the inserting side. The housing is provided at both the ends with projections having an oblique surface adapted to engage the projection of the slider. When the slider together with connection terminals of a flexible printed circuit board is inserted into the housing, the projections of the slider ride over the projections having the oblique surface of the housing so that the opening ends of the U-shaped arms of the slider are temporarily spread outwardly and then returned to their normal positions when the insertion has been completed.

Patent Literature 2

Japanese Patent Application Opened No. H13-257,020/2001 discloses one example of the so-called "piano touch" type connectors. With a view to obtaining an accurate positioning of a flexible printed circuit board or flexible flat cable relative to contacts of the disclosed connector, projections are provided in a row on a line on a terminal block between the contacts. After the flexible printed circuit board or flexible flat cable has been inserted into the terminal block, a slider is moved to press the circuit board or flat cable against the contacts. At the moment when the circuit board or flat cable is thus electrically connected to the contacts with the aid of the slider in this manner, the projections snap into recesses between patterns of the circuit board or flat cable, thereby ensuring positional coincidence between the contacts and patterns of the circuit board or flat cable.

Patent Literature 3

The Japanese Patent Application Opened No. 224,340/2002 discloses a connector which is capable of securely pressing a flexible printed circuit board or flexible flat cable against contact portions of contacts by a slider without degrading strength of respective parts and without detracting specifications, and which is superior in operationality or easy to use and easy to achieve narrower pitches of contacts and minimization of height or lower geometry of the connector. For the purpose of the lower geometry of the connector, the contacts each comprise an elastic portion and a fulcrum portion between the contact portion and a connection portion, and a pressure receiving portion at a position opposite to the connection portion and extending from the elastic portion, and the contact portion, the elastic portion, the fulcrum portion and the connection portion are arranged in the form of a crank. Moreover, the slider is provided with urging portions continuously in its longitudinal direction and is fitted in a housing so that the urging portions can be pivotally movable between the connection portions and the pressure receiving portions of the contacts.

In recent years, with miniaturization of electrical and electronic appliances, the requirement for the lower vertical geometry or minimization of height has put even more severe requirement on the connectors of this kinds using the flexible printed circuit board or flexible flat cable. With the connectors having the general construction, as is found in the patent literature 3, there are six layers in height, that is, the upper and lower walls of the housing, the contact portion and the pressure receiving portion of each of the contacts, the urging portion of the slider and the flexible printed circuit board or flexible flat cable. In order to reduce the connector's height as much as possible, it is possible to omit the pressure receiving portion of each of the contacts to obtain five layers in height (the upper and lower walls of the housing, the contact portion of each of the contacts, the urging portion of the slider and the flexible printed circuit board or flexible flat cable). It is however impossible to more reduce the height of the connector in consideration of strength of the respective members and specifications or customer's demands. Moreover, the insertion of the circuit board or flat cable and urging of the contact portions of the contacts against the circuit board or flat cable take place only on the side of the fitting opening of the housing for the circuit board or flat cable, so that as the connector is miniaturized, such operations would become more difficult.

In order to overcome such problems, the applicant has proposed the connector disclosed in the patent literature 3, which is capable of securely pressing the contact portions of the contacts against the flexible printed circuit board or flat cable without degrading the strength of the respective members and without detracting specifications and is superior in operationality or easy to use and easy to achieve narrower pitches of contacts and minimization of height or lower geometry of the connector.

With the construction of the connector as disclosed in the patent literature 3, however, when the contacts are inserted into the housing, the contacts are obliquely inserted with their contact portions relative to the wall of the housing in amount corresponding to clearances between the contacts and insertion grooves of the housing, resulting in irregular contact pressures, making the contact between the contacts and the board unstable. This problem remains to be solved.

SUMMARY OF THE INVENTION

It is an object of the invention to provide an improved connector which overcomes the above problems of the prior art and which can achieve stable connection between contacts and a flexible printed circuit board or flat cable without obliquely inserting the contacts into the housing of the connector.

The above object can be achieved by the connector to be detachably fitted with a flexible printed circuit board or a flexible flat cable according to the invention, comprising a required number of contacts having a contact portion to contact the flexible printed circuit board or flexible flat cable, a housing for holding and fixing therein the contacts and having a fitting opening for inserting the flexible printed circuit board or flexible flat cable, and a slider for pressing the flexible printed circuit board or flexible flat cable against the contacts, the contacts each having an elastic portion and a fulcrum portion between the contact portion and a connection portion, and a pressure receiving portion at a location opposite to the connection portion and extending from the elastic portion, and the contact portion, the elastic portion, the fulcrum portion, and the connection portion being arranged in the form of a crank, and the slider being provided with urging portions continuously in its longitudinal direction and being fitted in the housing so that the urging portions are pivotally movable between the connection portions and the pressure receiving portions of the contacts, wherein the housing comprises anchoring portions at locations corresponding to the connection portions of the contacts, and the connection portions of the contacts each comprise an oblique recess to engage the anchoring portion.

Moreover, the above object can also be accomplished by the connector to be detachably fitted with a flexible printed circuit board or a flexible flat cable, comprising a required number of contacts having a contact portion to contact the flexible printed circuit board or flexible flat cable, a housing for holding and fixing therein the contacts and having a fitting opening for inserting the flexible printed circuit board or flexible flat cable, and a slider for pressing the flexible printed circuit board or flexible flat cable against the contacts, the contacts consisting of two kinds of contacts which are arranged alternately staggered, the contacts of the one kind each having an elastic portion and a fulcrum portion between the contact portion and a connection portion, and a pressure receiving portion at a location opposite to the connection portion and extending from the elastic portion, and the contact portion, the elastic portion, the fulcrum portion, and the connection portion being arranged in the form of a crank, and the contacts of the other kind each having an elastic portion and a fulcrum portion between the contact portion and a connection portion, and a pressure receiving portion extending from the elastic portion in an opposite direction to the contact portion, and the contact portion, the elastic portion, the fulcrum portion and the connection portion being arranged in the form of a U-shape, and the slider being provided with urging portions continuously in its longitudinal direction and being fitted in the housing so that the urging portions are pivotally movable between the connection portions and the pressure receiving portions of the contacts of the one kind and between the housing and the pressure receiving portions of the contacts of the other kind, wherein according to the invention the housing comprises anchoring portions at locations corresponding to the connection portions of the contacts, and the connection portions of the contacts each comprise an oblique recess to engage the anchoring portion.

According to the invention, the contacts are installed in the connector in the manner that when the contacts are inserted into the housing from the opposite side of the fitting opening, the contact portions of the contacts are substantially parallel to insertion grooves of the housing during a stage at the beginning of engagement of the anchoring portions of the housing with the recesses, but on proceeding of the insertion the contacts are obliquely inclined so that the contact portions contact upper walls of the insertion grooves, and when the insertion has been completed, the contact portions return into parallel with the insertion grooves with the aid of said oblique recesses.

With the connector according to the invention, after a flexible printed. circuit board has been inserted into the housing of the connector, the slider is pivotally moved in the insertion direction of the circuit board to raise the pressure receiving portions of the contacts by the urging portions of the slider so that the elastic portions of the contacts are tilted toward the contact portions about the fulcrum portions of the contacts, thereby securely pressing the contact against the flexible printed circuit board or flat cable.

The connector according to the invention can bring about the following significant functions.

(1) According to the invention, the connector to be detachably fitted with a flexible printed circuit board or a flexible flat cable comprises a required number of contacts having a contact portion to contact the flexible printed circuit board or flexible flat cable, a housing for holding and fixing therein the contacts and having a fitting opening for inserting the flexible printed circuit board or flexible flat cable, and a slider for pressing the flexible printed circuit board or flexible flat cable against the contacts, the contacts each having an elastic portion and a fulcrum portion between the contact portion and a connection portion, and a pressure receiving portion at a location opposite to the connection portion and extending from the elastic portion, and the contact portion, the elastic portion, the fulcrum portion, and the connection portion being arranged in the form of a crank, and the slider being provided with urging portions continuously in its longitudinal direction and being fitted in the housing so that the urging portions are pivotally movable between the connection portions and the pressure receiving portions of the contacts, wherein the housing comprises anchoring portions at locations corresponding to the connection portions of the contacts, and the connection portions of the contacts each comprise an oblique recess to engage the anchoring portion. With this construction, the connector according to the invention achieves its remarkable minimization in height less than 0.9 mm. Moreover, even if there are clearances between the contacts and the insertion grooves of the housing, the contacts are inserted and fixed in the insertion grooves in parallel therewith without any inclination, thereby achieving stable connection between the contacts and a flexible printed circuit board or flat cable.

(2) According to the invention, the connector to be detachably fitted with a flexible printed circuit board or a flexible flat cable, comprises a required number of contacts having a contact portion to contact the flexible printed circuit board or flexible flat cable, a housing for holding and fixing therein the contacts and having a fitting opening for inserting the flexible printed circuit board or flexible flat cable, and a slider for pressing the flexible printed circuit board or flexible flat cable against the contacts, the contacts consisting of two kinds of contacts which are arranged alternately staggered, the contacts of the one kind each having an elastic portion and a fulcrum portion between the contact portion and a connection portion, and a pressure receiving portion at a location opposite to the connection portion and extending from the elastic portion, and the contact portion, the elastic portion, the fulcrum portion, and the connection portion being arranged in the form of a crank, and the contacts of the other kind each having an elastic portion and a fulcrum portion between the contact portion and a connection portion, and a pressure receiving portion extending from the elastic portion in an opposite direction to the contact portion, and the contact portion, the elastic portion, the fulcrum portion and the connection portion being arranged in the form of a U-shape, and the slider being provided with urging portions continuously in its longitudinal direction and being fitted in the housing so that the urging portions are pivotally movable between the connection portions and the pressure receiving portions of the contacts of the one kind and between the housing and the pressure receiving portions of the contacts of the other kind, wherein the housing comprises anchoring portions at locations corresponding to the connection portions of the contacts, and the connection portions of the contacts each comprise an oblique recess to engage the anchoring portion. With this construction, therefore, the connector according to the invention achieves its remarkable minimization in height less than 0.9 mm and also achieves even narrower pitches of the contacts. Moreover, even if there are clearances between the contacts and the insertion grooves of the housing, the contacts are inserted and fixed in the insertion grooves in parallel therewith without any inclination, thereby achieving stable connection between the contacts and a flexible printed circuit board or flat cable.

(3) According to the invention, the contacts are inserted into the housing from the opposite side of the fitting opening, the contact portions of the contacts are substantially parallel to insertion grooves of the housing during a stage at the beginning of engagement of the anchoring portions of the housing with the recesses, but on proceeding of the insertion the contacts are obliquely inclined so that the contact portions contact upper walls of the insertion grooves, and when the insertion has been completed, the contact portions return into parallel with the insertion grooves with the aid of the oblique recesses. With such a construction of the connector according to the invention, even if the contacts are obliquely inserted into the insertion grooves of the housing due to clearances between the contacts and the insertion grooves, the contacts finally return to parallel position to the insertion grooves, thereby obtaining stable connection between the contacts and a flexible printed circuit board or flat cable.

The invention will be more fully understood by referring to the following detailed specification and claims taken in connection with the appended drawings.

DESCRIPTION OF THE PREFERRED EMBODIMENTS

Figure 1A:
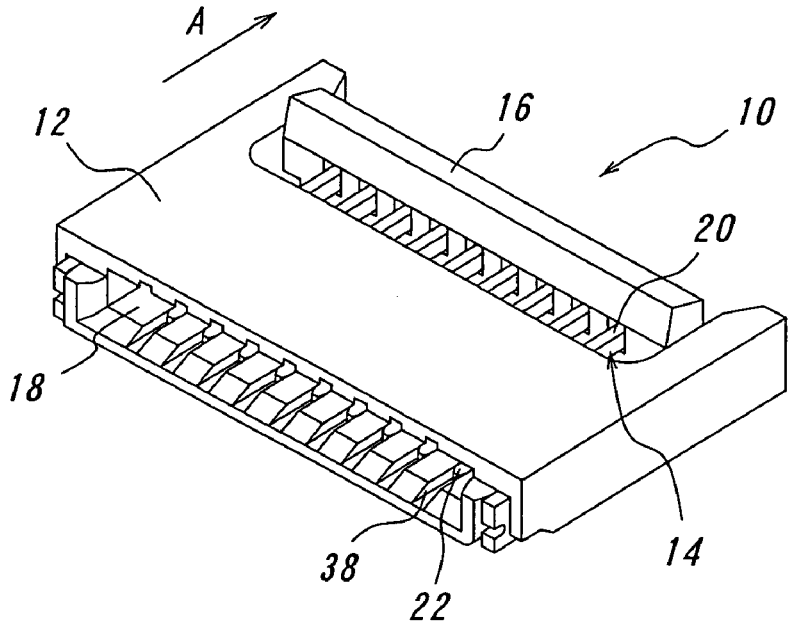
FIG. 1A is a perspective view of a connector of one embodiment according to the invention viewed from the side of its fitting opening for inserting a flexible printed circuit board or flat cable.
Figure 1B:
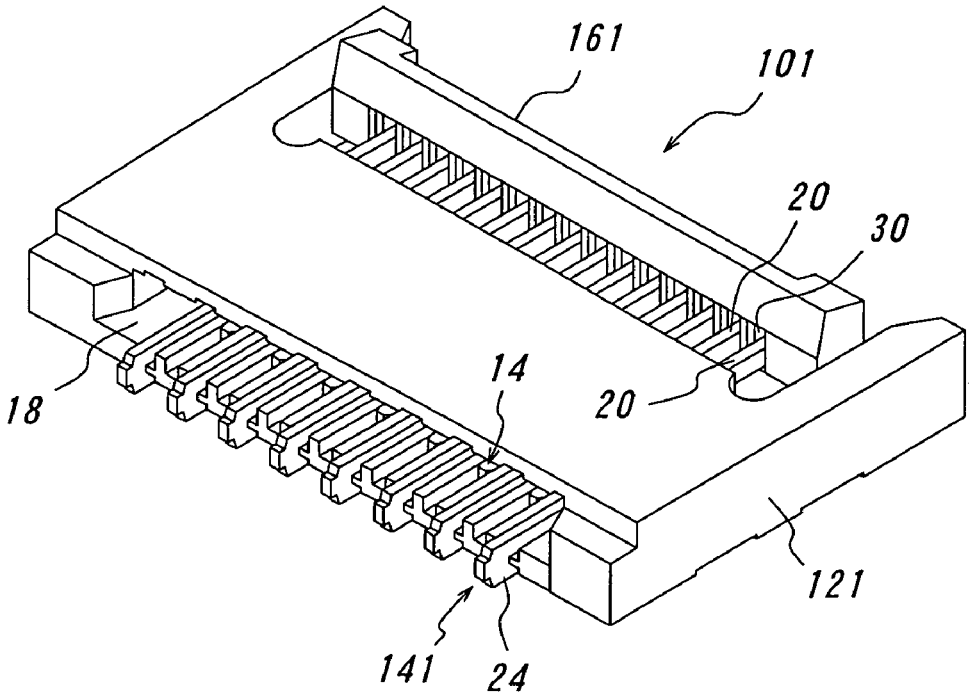
FIG. 1B is a perspective view of a connector with contacts arranged in staggered or zigzag fashion of another embodiment according to the invention viewed from the side of its fitting opening.
Figure 2A:
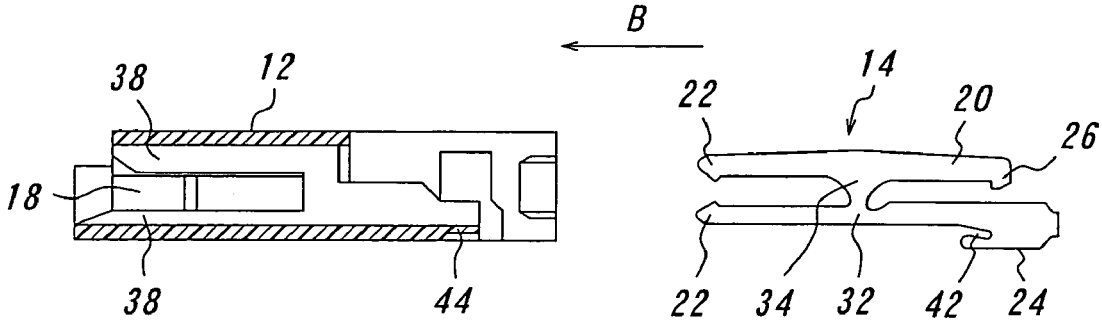
FIGS. 2A to 2D are views for explaining successive steps when contacts are inserted into the housing of the connector according to the invention.
Figure 2B:
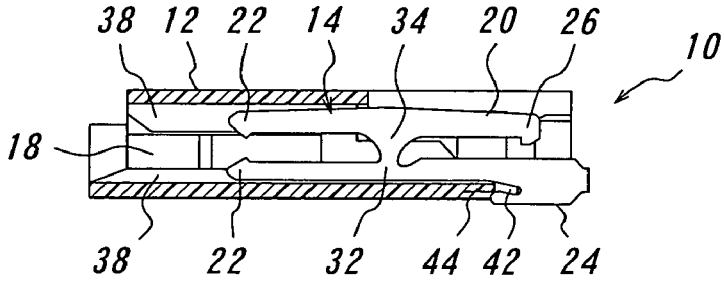
Figure 2C:
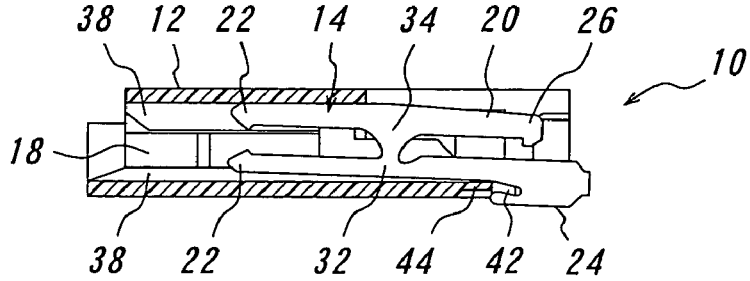
Figure 2D:
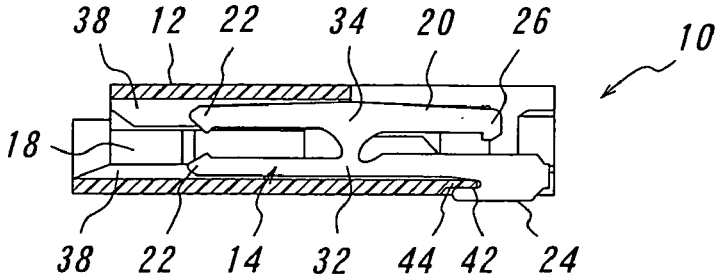
Figure 3A:
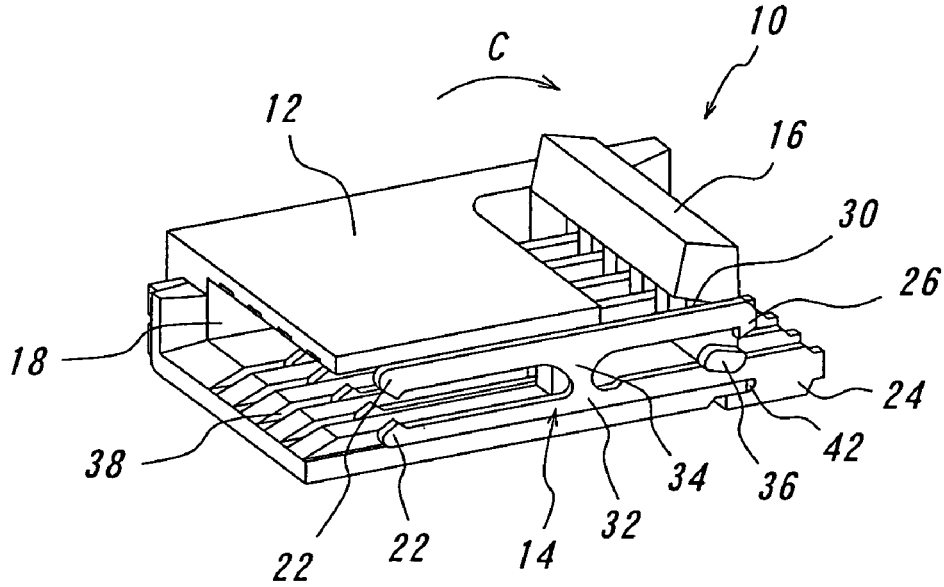
FIG. 3A is a partly sectional perspective view of the connector according to the invention before the contacts are inserted into the housing.
Figure 3B:
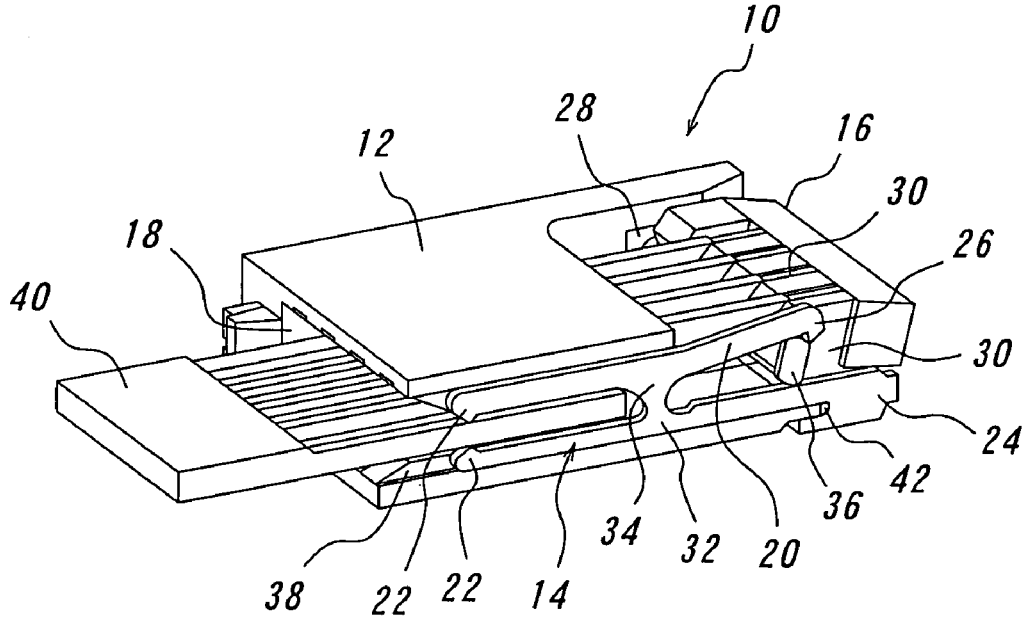
FIG. 3B is a partly sectional perspective view of the connector according to the invention after a flexible printed circuit board has been inserted into the housing and the slider has been pivotally moved.

A connector 10 according to the invention will be explained with reference to the drawings. FIG. 1A is a perspective view of the connector according to the invention viewed from the side of its fitting opening, and FIG. 1B is a perspective view of the connector with contacts arranged in staggered or zigzag fashion, viewed from the fitting opening. FIGS. 2A to 2D are explanatory views for mounting contacts in its housing. FIG. 3A is a partly sectional perspective view of the connector before a flexible printed circuit board is inserted therein and FIG. 3B is a partly sectional perspective view of the connector after the flexible printed circuit board has been inserted and a slider has been pivotally moved. The connector 10 according to the invention mainly comprises the housing 12, the slider 16 and the contacts 14.

The components of the connector 10 according to the invention will be explained by referring to the drawings. First, the contacts 14 forming one important aspect of the invention will be explained. The contacts 14 are formed by the known press-working from a metal. Preferred metals from which to form the contacts 14 include brass, beryllium copper, phosphor bronze and the like to fulfil the requirements imposed thereon such as springiness, conductivity and the like.

As shown in FIG. 3A, the contact 14 is substantially "H-shaped" and mainly composed of an upper contact portion 22 adapted to contact the flexible printed circuit board 40 or a flexible flat cable, a connection portion 24 adapted to be connected to a board or substrate, a fixed portion to be fixed to the housing 12, an elastic portion 34 and a fulcrum portion 32 provided between the contact portion 22 and the connection portion 24, a pressure receiving portion 20 positioned opposite to the connection portion 24 and extending from the elastic portion 34, and a further or lower contact portion 22 extending from the fulcrum portion 32 and adapted to contact the flexible printed circuit board 40 or the flexible flat cable. The upper contact portion 22 (positioned on the upper side viewed in FIG. 3A), the elastic portion 34, the fulcrum portion 32 and the connection portion 24 are arranged substantially in the form of a crank. The contact portions 22 are each formed with a protrusion at a free end to facilitate contacting with the flexible circuit board 40 or flat cable. Although the connection portions 24 are shown as a surface mounting type (SMT) in the embodiment shown in FIG. 1, it will be apparent that they may be of a dip type. In the illustrated embodiment, there are provided the two contact portions 22 to embrace therebetween a flexible printed circuit board 40 or a flexible flat cable. In more detail, by providing the two contact portions 22 on each contact on both the sides of the insertion direction of the flexible printed circuit board or flexible flat cable to embrace the board or cable therebetween, thereby achieving a reliable connection therebetween.

The contacts 14 are each formed in its connection portion with an oblique recess 42 adapted to engage an anchoring portion 44 (later described) formed on the housing 12. The oblique recess 42 serves as a guide when the contact 14 is mounted in the housing 12. The shape and size of the recess 42 may be suitably designed so that it operates in a manner described below. In the illustrated embodiment, the recess is an oblique notch and 0.08 mm in size.

The contacts 14 are mounted in the housing 12 in the following manner which will be explained by referring to FIGS. 2A to 2D. The contact 14 is inserted into the housing 12 in the direction shown by an arrow B from the opposite side of the fitting opening 18 as shown in FIG. 2A. At the commencement of the engagement of the anchoring portion 44 of the housing 12 with the oblique recess 42 of the contact 14, the contact portions 22 of the contact 14 is substantially in parallel with an inserting hole 38 of the housing 12 as shown in FIG. 2B. When the contact 14 is further inserted into the housing 12, the contact will be tilted by clearances between the contact 14 and the inserting hole 38 of the housing 12 so that the upper contact portion 22 of the contact 14 comes into contact with the upper wall of the inserting hole 38 as shown in FIG. 2C. When the insertion of the contact has been completed, the upper contact portion 22 of the contact has returned into parallel with the inserting hole 38 because the contact 14 has been guided by its oblique recess 42 as shown in FIG. 2D.

The fulcrum portion 32, the elastic portion 34 and the pressure receiving portion 20 will achieve the following functions when a flexible printed circuit board 40 or flexible flat cable is inserted into the connector. After the flexible printed circuit board 40 or flexible flat cable has been inserted into the fitting opening 18 of the housing 12, urging portions 36 of a slider 16 are pivotally moved between the connection portions 24 and the pressure receiving portions 20 of the contacts 14 to raise the pressure receiving portions 20 by the urging portions 36 so that the elastic portions 34 of the contacts 14 are tilted toward the contact portions 22 about the fulcrum portions 32, thereby pressing the contact portions 22 against the flexible printed circuit board 40 or flexible flat cable (the slider 16 having the urging portions 36 being explained in detail later). The sizes and shapes of the fulcrum portion 32, the elastic portion 34 and the pressure receiving portion 20 are suitably designed to perform their functions described above.

It is preferable to provide a projection 26 shown in FIG. 2A at the free end of the pressure receiving portion 20 of the contact 14 to prevent the slider 16 from being deformed at its center in the direction shown by an arrow A in FIG. 1A due to strong reaction against the pivotal movement of the slider 16 when causing its urging portions 36 to pivotally move between the connection portions 24 and the pressure receiving portions 20 of the contacts 14. The projection 26 may be formed in any size so long as its can perform its function and may be so designed that the urging portion 36 of the slider 16 securely engages the projection 26.

A contact (not shown) different from the contact 14 described above will be explained. The contact is substantially "h-shaped" which does not have the lower contact portion 22 of the contact 14.

The housing 12 will then be explained. The housing 12 is injection-molded from an electrically insulating plastic material in the conventional manner. Preferred materials from which to form the housing 12 include polybutylene terephthalate (PBT), polyamide (66PA or 46PA), liquid crystal polymer (LCP), polycarbonate (PC) and the like and combination thereof in view of the requirements imposed on the housing 12 with respect to dimensional stability, workability, manufacturing cost and the like.

The housing 12 is formed with inserting holes 38 in which a required number of contacts 14 are inserted, respectively, and fixed thereat, by press-fitting, hooking (lancing), welding or the like. The housing 12 is formed with the anchoring portions 44 at locations corresponding to the connection portions 24 of the contacts 14. The anchoring portions 44 serve as guides when the contacts are inserted into the inserting holes 38 of the housing 12 for mounting the contacts therein as described above. The size of the anchoring portions 44 may be suitably designed so as to achieve their function and is of the order of 0.1 mm in the embodiment.

The housing 12 is further provided in the proximity of the longitudinal ends with holes or bearings for rotatably supporting axles 28 of the slider 16. The holes or bearing of the housing 12 may be in any shape and size so long as the slider 16 can be rotated and may be suitably designed in consideration of their functions and the strength and size of the housing 12. The housing 12 is further provided at the longitudinal ends with anchoring portions at locations corresponding to locking portions (later described) of the slider 16.

Finally, the slider 16 will be explained hereafter. The slider 16 is injection-molded from an electrically insulating plastic material in the conventional manner. Preferred materials from which to form the slider 16 include polybutylene terephthalate (PBT), polyamide (66PA or 46PA), liquid crystal polymer (LCP), polycarbonate (PC) and the like and combination thereof in view of the requirements imposed on the slider 16 with respect to dimensional stability, workability, manufacturing cost and the like. The slider 16 mainly comprises axles 28 adapted to be rotatably fitted in the housing 12, the urging portions 36 for urging the pressure receiving portions 20 of the contacts 14, and anchoring grooves 30 adapted to be engaged with the projections 26 of the contacts 14. The axles 28 are fulcrums for the pivotal movement of the slider 16 and fitted in the holes or bearings in the housing 12 at the location in the proximity of its longitudinal ends. The slider 16 is further provided at the longitudinal ends with locking portions adapted to engage the housing 12 for preventing the slider 16 from being lifted (in the upward direction in the drawing) when the pressure receiving portions 20 of the contacts 14 are urged by the urging portions 36 of the slider 16. The locking portions may be in any size and shape so long as they can engage the housing 12 and may be suitably designed in consideration of their function and the size and strength of the connector 10.

The urging portions 36 serve to push the pressure receiving portions 20 of the contacts 14 and are preferably of an elongated shape, elliptical in the illustrated embodiment.

With such an elliptical shape, when the slider is pivotally moved in the direction shown by an arrow C in FIG. 3A so as to rotate its urging portion in the space between the pressure receiving portions 20 and the connection portions 24 of the contacts 14, the pressure receiving portions 20 of the contacts 14 are moved upward with variation in contacting height owing to the elliptical shape of the urging portions 36, resulting in the reliable clamping of the flexible printed circuit board 40 or flat cable by the contact portions 24 of the contacts 14. The urging portions 36 may be formed in any shape insofar as they can rotate between the pressure receiving portions 20 and the connection portions 24 of the contacts 14, and the pressure receiving portions 20 of the contacts 14 can be raised with the aid of the variation in contacting height owing to, for example, difference in major and minor axes of an ellipse.

The slider 16 is further provided with the anchoring grooves 30 independently from each other, which are adapted to engage the projections 26 of the contacts 14 for the purpose of preventing the slider 16 from being deformed at the middle in the direction shown by the arrow A in FIG. 1A due to the reaction against the pivotal movement of the slider 16 when being pivotally moved. The independently provided anchoring grooves 30 serve to increase the strength of the slider 16 and to prevent its deformation when being pivotally moved.

Another embodiment of the invention will be explained with reference to FIG. 1B. The connector 101 of this embodiment mainly comprises a housing 121, contacts 14 and 141 and a slider 161 as is also the case in the connector 10 described above. The subject matter of the connector 101 of this embodiment lies in the fact that the two kinds of the contacts 14 and 141 are arranged to be alternately staggered by inserting the contacts into the housing in opposite directions alternately, thereby achieving narrower pitches of the contacts and lower geometry or minimization of height of the connector. The housing 121, the slider 161 and the contacts 14 will not be described in further detail since these members are substantially similar to the corresponding members of the connector 10 described above.

The other contacts 141 are also formed by press-working from the metal similar to that of the contacts 14.

Likewise, the contacts 141 have two types, "h-shaped" and "H-shaped". The "h-shaped" contact 141 mainly composed of a contact portion 22 adapted to contact the flexible printed circuit board 40 or flexible flat cable, a connection portion 24 adapted to be connected to a board or substrate, a fixed portion to be fixed to the housing, an elastic portion 34 and a fulcrum portion 32 provided between the contact portion and the connection portion 24, and a pressure receiving portion 20 extending from the elastic portion 34. The contact portion 22, the elastic portion 34, the fulcrum portion 32 and the connection portion 24 are arranged in U-shape. In addition to the respective portions provided in the "h-shaped" contact, the "H-shaped" contact is provided with an extension portion extending from the fulcrum portion 32 in an opposite direction to the connection portion 24. The contact portions 22 are each formed with a protrusion at a free end to facilitate contacting with the flexible printed circuit board 40 or flexible flat cable. Although the connection portions 24 are of a surface mounting type (SMT) in the embodiment as shown in FIG. 1B, they may be of a dip type.

With the contacts 141 similarly to the contacts 14, after the flexible printed circuit board 40 or flexible flat cable has been inserted into fitting opening of the housing, the urging portions 36 of a slider 161 are pivotally moved between the pressure receiving portions 20 of the contacts 141 and the housing 121 or between the pressure receiving portions 20 and the extension portions to raise the pressure receiving portions 20 by the urging portions 36 so that the elastic portions 34 of the contacts 141 are tilted toward the contact portions 22 about the fulcrum portions 32, thereby pressing the contact portions 22 against the flexible printed circuit board 40 or flexible flat cable. The sizes and shapes of the fulcrum portion 32, the elastic portion 34 and the pressure receiving portion 20 may be suitably designed to perform their functions described above.

Moreover, it is preferable to provide a projection 26 at the free end of the pressure receiving portion 20 of the contact 141 to prevent the slider 161 from being deform at its center in the connection direction (mounting direction of the slider) due to strong reaction against the pivotal movement of the slider 161 when causing its urging portion to pivotally move. However, it may be sufficient to provide the projections 26 only on one kind of the contacts 14 among the two kinds of contacts 14 and 141 because of the strength of the slider 161 improved by narrower pitches of the contacts. The projection 26 may be formed in any size so long as it can perform its function and may be so designed that the urging portion 36 of the slider 161 securely engages the projection 26.

The present invention is preferably applicable to connectors for use in mobile phones or cellular phones, notebook personal computers, digital cameras and the like and having a mechanism for pressing contacts 14 and 141 against a flexible printed circuit board 40 or flexible flat cable. Particularly, the connector according to the invention is capable of inserting the contacts into a housing to be parallel to insertion grooves without obliquely positioning.

While the invention has been particularly shown and described with reference to the preferred embodiments thereof, it will be understood by those skilled in the art that the foregoing and other changes in form and details can be made therein without departing from the spirit and scope of the invention.

What is claimed is:

1. A connector to be detachably fitted with a flexible printed circuit board or a flexible flat cable, comprising a required number of contacts having a contact portion to contact said flexible printed circuit board or flexible flat cable, a housing for holding and fixing therein said contacts and having a fitting opening for inserting said flexible printed circuit board or flexible flat cable, and a slider for pressing said flexible printed circuit board or flexible flat cable against said contacts, said contacts each having an elastic portion and a fulcrum portion between said contact portion and a connection portion, and a pressure receiving portion at a location opposite to said connection portion and extending from said elastic portion, and said contact portion, said elastic portion, said fulcrum portion, and said connection portion being arranged in the form of a crank, and said slider being provided with urging portions continuously in its longitudinal direction and being fitted in said housing so that said urging portions are pivotally movable between said connection portions and said pressure receiving portions of said contacts, wherein said housing comprises:

insertion grooves; and anchoring portions at locations corresponding to said connection portions of said contacts, and said connection portions of said contacts each comprise an oblique recess to engage said anchoring portions; and wherein the mutual shape and size of each of said anchoring portions and said oblique recesses are arranged when said contacts are first inserted into said housing such that the contact portions of said contacts are substantially parallel to the insertion grooves of said housing, and on further proceeding of insertion, the contacts are obliquely inclined so that said contact portions contact with upper walls of said insertion grooves, and when the insertion has been completed, said contact portions return into parallel with the insertion grooves with the aid of said oblique recesses.

2. The connector of claim 1, wherein said oblique recess is an oblique notch and 0.08 mm. in size.

3. The connector of claim 1, wherein the size of each anchoring portion is of the order of 0.1 mm.

4. A connector to be detachably fitted with a flexible printed circuit board or a flexible flat cable, comprising a required number of contacts having a contact portion to contact said flexible printed circuit board or flexible flat cable, a housing for holding and fixing therein said contacts and having a fitting opening for inserting said flexible printed circuit board or flexible flat cable, and a slider for pressing said flexible printed circuit board or flexible flat cable against said contacts, said contacts consisting of two kinds of contacts which are arranged alternately staggered, the contacts of the one kind each having an elastic portion and a fulcrum portion between said contact portion and a connection portion, and a pressure receiving portion at a location opposite to said connection portion and extending from said elastic portion, and said contact portion, said elastic portion, said fulcrum portion, and said connection portion being arranged in the form of a crank, and the contacts of the other kind each having an elastic portion and a fulcrum portion between said contact portion and a connection portion, and a pressure receiving portion extending from said elastic portion in an opposite direction to said contact portion, and said contact portion, said elastic portion, said fulcrum portion and said connection portion being arranged in the form of a U-shape, and said slider being provided with urging portions continuously in its longitudinal direction and being fitted in said housing so that said urging portions are pivotally movable between said connection portions and said pressure receiving portions of the contacts of the one kind and between said housing and said pressure receiving portions of the contacts of the other kind, wherein said housing comprises:

insertion grooves; and anchoring portions at locations corresponding to said connection portions of said contacts, and said connection portions of said contacts each comprise an oblique recess to engage said anchoring portions; and wherein the mutual shape and size of each of said anchoring portions and said oblique recesses are arranged when said contacts are first inserted into said housing such that the contact portions of said contacts are substantially parallel to the insertion grooves of said housing, and on further proceeding of insertion, the contacts are obliquely inclined so that said contact portions contact with upper walls of said insertion grooves, and when the insertion has been completed, said contact portions return into parallel with the insertion grooves with the aid of said oblique recesses.

5. The connector of claim 4, wherein said oblique recess is an oblique notch being about 0.08 mm. in size.

6. The connector of claim 4, wherein the size of each anchoring portion is of the order of 0.1 mm.

* * * * *